US009075334B2

(12) United States Patent
Araki

(10) Patent No.: US 9,075,334 B2
(45) Date of Patent: Jul. 7, 2015

(54) IMAGE FORMING APPARATUS DETERMINING CHARGED POTENTIAL FLUCTUATION OF PHOTOSENSITIVE MEMBER

(71) Applicant: CANON KABUSHIKI KAISHA, Tokyo (JP)

(72) Inventor: Go Araki, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 105 days.

(21) Appl. No.: 13/895,565

(22) Filed: May 16, 2013

(65) Prior Publication Data

US 2014/0003828 A1 Jan. 2, 2014

(30) Foreign Application Priority Data

Jun. 28, 2012 (JP) ..... 2012-146083

(51) Int. Cl.
*G03G 15/00* (2006.01)
*G03G 15/02* (2006.01)

(52) U.S. Cl.
CPC ..... *G03G 15/0266* (2013.01)

(58) Field of Classification Search
CPC G03G 15/55; G03G 15/5033; G03G 15/0266
USPC ..... 399/50, 51, 26
See application file for complete search history.

(56) References Cited

U.S. PATENT DOCUMENTS

| | | | | |
|---|---|---|---|---|
| 6,690,897 | B2 | 2/2004 | Takami | |
| 7,257,338 | B2 | 8/2007 | Yoshida | |
| 2008/0122460 | A1* | 5/2008 | Ichikawa et al. | 324/699 |

FOREIGN PATENT DOCUMENTS

| | | | |
|---|---|---|---|
| JP | 2002-229306 | A | 8/2002 |
| JP | 2005-208147 | A | 8/2005 |
| JP | 2011-180458 | A | 9/2011 |
| JP | 2012-133052 | A | 7/2012 |

* cited by examiner

*Primary Examiner* — David Bolduc
*Assistant Examiner* — Barnabas Fekete
(74) *Attorney, Agent, or Firm* — Fitpatrick, Cella, Harper & Scinto

(57) ABSTRACT

An image forming apparatus includes: a photosensitive member driven rotary; a charging unit configured to charge the photosensitive member; an exposure unit configured to form an electrostatic latent image on the photosensitive member by exposing the charged photosensitive member; a detecting unit configured to detect a current flowing between the charging unit and the photosensitive member; and a correction unit configured to determine a fluctuation location and a fluctuation amount of the charged potential of the photosensitive member, according to a fluctuation amount of the current detected by the detecting unit, and to correct an amount of light irradiated by the exposure unit onto the photosensitive member at the fluctuation location of the charged potential according to the determined fluctuation amount of the potential.

25 Claims, 16 Drawing Sheets

IMAGE FORMING APPARATUS DETERMINING CHARGED POTENTIAL FLUCTUATION OF PHOTOSENSITIVE MEMBER

BACKGROUND OF THE INVENTION

1. Field of the Invention

The present invention relates to an image forming apparatus which suppresses degradation of an image caused by fluctuation in charged potential of a photosensitive member.

2. Description of the Related Art

Image forming apparatuses that use an electrophotographic process or an electrostatic recording process are in widespread use, and a certain level of quality is required for images formed by these image forming apparatuses. Here, as one factor that degrades image quality, density unevenness in a conveyance direction of a recording material (sub-scanning direction) can be pointed out, with this being caused by leaving a photosensitive member, which is a charged body, and a charging unit being pressed together for an extended period.

For example, in a case where the photosensitive member is charged by a charge roller, a discharge gap between the charge roller and the photosensitive member needs to be kept constant. Therefore, the surface of the charge roller is made smooth. However, in a case where a contact charging method is used, when the charge roller is left for an extended period in a state of being pressed against the photosensitive member, the charge roller may be deformed at the contact area with the photosensitive member (hereinafter, this deformation is referred to as a pressed mark, or simply a mark). This situation corresponds, for example, to a case in which a process cartridge having the charge roller is left unused for an extended period. For the charge roller having a mark, the discharge gap between the charge roller and the photosensitive member cannot be maintained constant. Accordingly, when charging of the photosensitive member is performed by the charge roller with a mark, fluctuation of the charged potential of the photosensitive member occurs when the mark of the charge roller passes a discharging area, and as a result density unevenness occurs in a rotation cycle of the charge roller.

Japanese Patent Laid-Open No. 2002-229306 proposes to suppress the density unevenness by controlling the amplitude of the fluctuation of a charging voltage that is applied to the charge roller to be no larger than 1%, when the mark of the charge roller passes the discharging area.

However, in order to control the amplitude of the fluctuation of the charging voltage to be no larger than 1%, a high-voltage capacitor is required to suppress the amplitude of the fluctuation of DC voltage, which causes an increase in costs. Furthermore, in the configuration disclosed in the Japanese Patent Laid-Open No. 2002-229306, although the density unevenness caused by the mark can be suppressed by increasing the capacitance of the high-voltage capacitor, the rise time of the charging output becomes longer. Accordingly, a difference in the charged potential of the photosensitive member occurs depending on the location of the charge roller, and the density unevenness caused by this difference in the charged potential may arise. Note that as another solution to resolve the problem of the mark, a configuration in which extended pressing does not physically occur by separating the photosensitive member and the charge roller can be considered. However, the mechanical configuration needs to be modified, which results in significant cost increase. As described above, density unevenness which is caused by fluctuation of the charged potential of a photosensitive member that occurs at a mark of the charge roller or the like needs to be suppressed.

SUMMARY OF THE INVENTION

The present invention provides an image forming apparatus which suppresses density unevenness by a low-cost configuration, even if the charged potential of a photosensitive member fluctuates.

According to an aspect of the present invention, an image forming apparatus includes: a photosensitive member driven rotary; a charging unit configured to charge the photosensitive member; an exposure unit configured to form an electrostatic latent image on the photosensitive member by exposing the charged photosensitive member; a detecting unit configured to detect a current flowing between the charging unit and the photosensitive member; and a correction unit configured to determine a fluctuation location and a fluctuation amount of the charged potential of the photosensitive member, according to a fluctuation amount of the current detected by the detecting unit, and to correct an amount of light irradiated by the exposure unit onto the photosensitive member at the fluctuation location of the charged potential according to the determined fluctuation amount of the potential.

Further features of the present invention will become apparent from the following description of exemplary embodiments with reference to the attached drawings.

DESCRIPTION OF THE EMBODIMENTS

Exemplary embodiments of the present invention will be described in detail with reference to the accompanying drawings. Note that in the following drawings, constituent elements which are not necessary to describe the embodiments will be omitted. Note that the following embodiments are for the purpose of description, and do not limit the scope of the present invention. Similarly, although in the following description, a description is given assuming that a deformation of a charge roller is caused by leaving the charge roller pressed against a photosensitive member, the present invention can also be applied to the fluctuation of charged potential of a photosensitive member caused by other factors, such as fluctuation due to factors besides extended pressing.

First Embodiment

Figure 2:
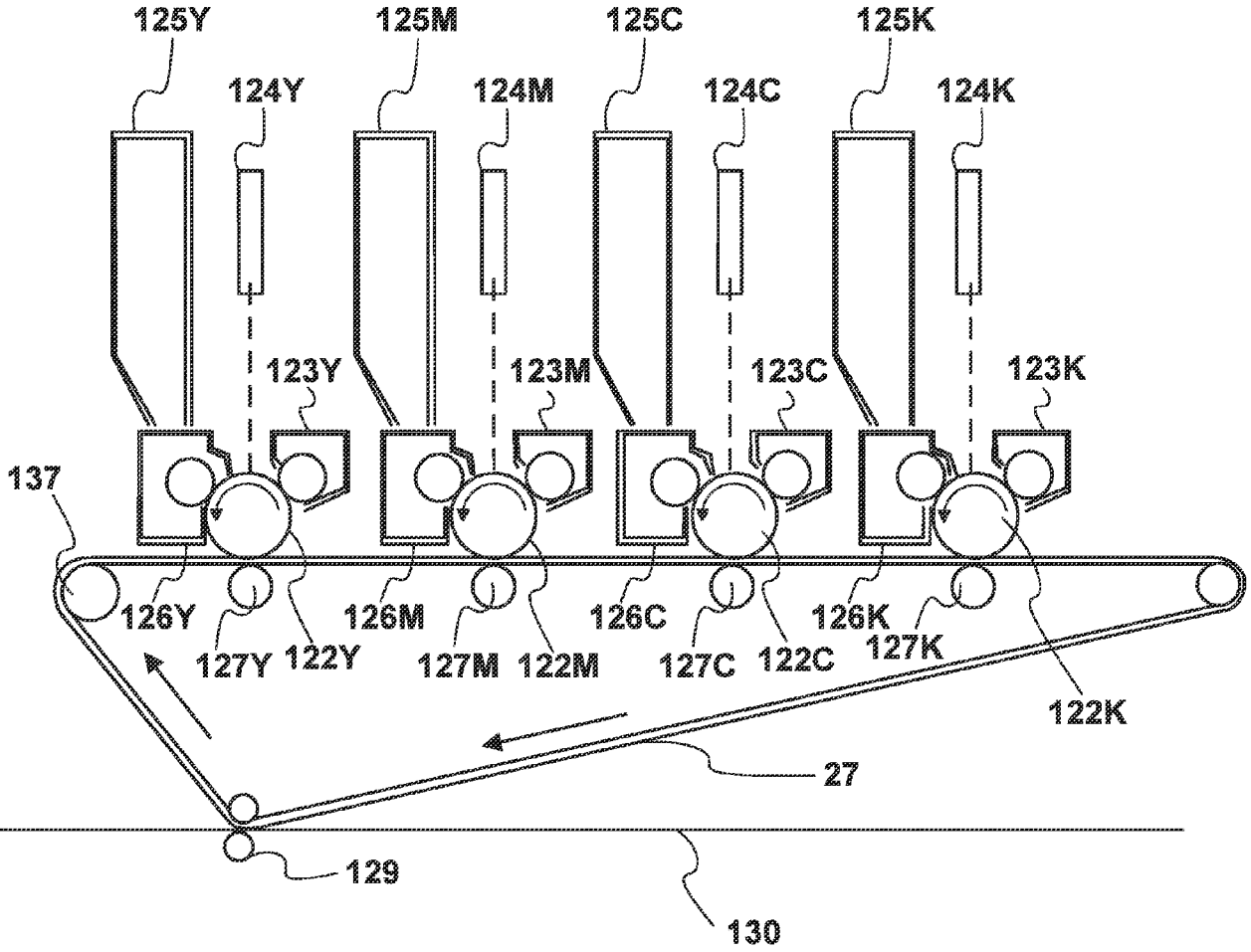
FIG. 2 is a diagram illustrating a configuration of an image forming unit in an image forming apparatus according to an embodiment.

FIG. 2 is a diagram illustrating a configuration of an image forming unit in an image forming apparatus according to the present embodiment. Note that the image forming apparatus in FIG. 2 forms a color image by superimposing images of the four colors yellow (Y), magenta (M), cyan (C), and black (K). Note that in the diagrams that are used in the following description, constituent elements with reference numerals to which the letters Y, M, C, and K are added are members for respectively forming yellow (Y), magenta (M), cyan (C), and black (K) toner images on an intermediate transfer belt 27. Note that in the following description, when the colors do not need to be distinguished, reference numerals without the letters Y, M, C and K will be used.

A photosensitive member 122 is rotary driven by a driving motor, which is not shown, in a direction designated by an arrow in the diagram. A charging unit 123 has a charge roller which is rotary driven and charges the corresponding photosensitive member 122. For example, the charge roller in the charging unit 123 outputs a voltage of −1200V, and a surface of the photosensitive member 122 is charged to, for example, −700V. Note that a configuration is possible in which pre-exposure to remove residual charges by irradiating a laser beam or LED light, which is not shown in the diagram, is performed just before charging the photosensitive member 122.

An exposure unit 124 irradiates a laser beam emitted depending on the image data of an image to be formed to form an electrostatic latent image on a toner image forming area of the photosensitive member 122. The surface potential of the photosensitive member 122 on which the laser beam is irradiated will be, for example, −100V.

A development unit 126 includes a development roller and toner of a corresponding color, and forms a single-color toner image by developing the electrostatic latent image with the toner using a voltage of, for example, −350V which is output from the development roller. Furthermore, a toner container 125 supplies the toner of the corresponding color to the corresponding development unit 126.

A primary transfer roller 127 outputs, for example, +1000V, and transfers the toner image formed on the photosensitive member 122 to the intermediate transfer belt 27. A drive roller 137 receives a drive force of a drive motor (not shown) and rotates the intermediate transfer belt 27 in the direction designated by an arrow shown in the diagram by this force. For example, each primary transfer roller 127 transfers the single-color toner image on the corresponding photosensitive member 122 to the intermediate transfer belt 27 so as to be superimposed thereon, and a multicolor toner image is formed.

A secondary transfer roller 129 outputs a transfer voltage, and thereby causes the toner image formed on the intermediate transfer belt 27 to be transferred to a recording material which is conveyed on a conveyance path 130. The recording material is, subsequently, conveyed to a fixing unit not shown in the diagram, and in the fixing unit, the toner image formed on the recording material is fixed by heat and pressure.

Note that although the image forming apparatus in FIG. 2 uses a laser as a light source of the exposure unit 124, an LED may be used. Furthermore, the image forming apparatus in FIG. 2 includes the intermediate transfer belt 27. However, the toner image formed on a photosensitive member 122 may be transferred directly to a recording material. Furthermore, although the photosensitive member 122 in FIG. 2 has a drum like shape, a photosensitive belt which is a photosensitive member having a belt structure may be charged, and an electrostatic latent image may be formed thereon.

Figure 3:
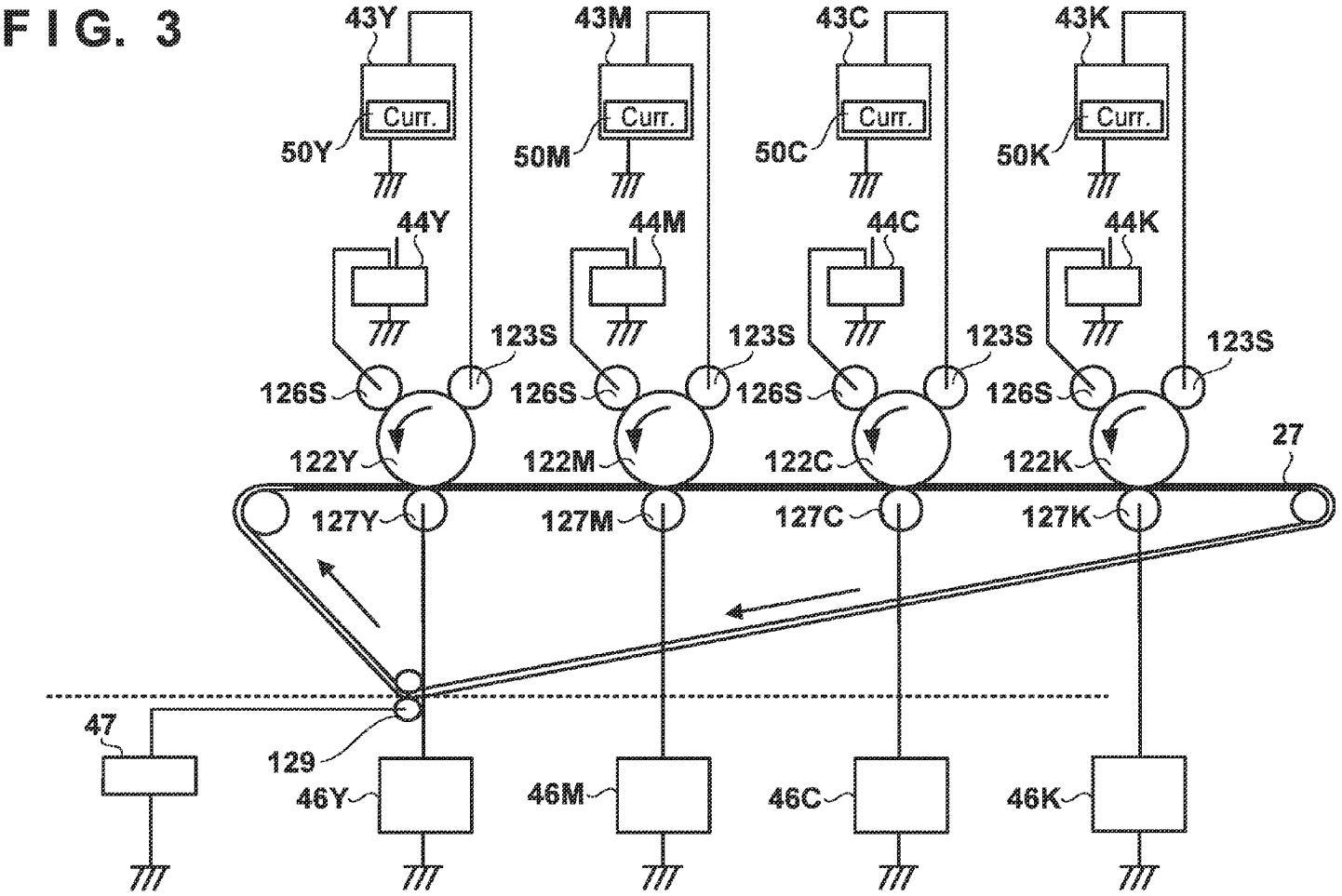
FIG. 3 is a diagram illustrating a voltage supply system to the image forming unit according to an embodiment.

FIG. 3 illustrates a voltage supply system to the charging unit 123, the development unit 126, the primary transfer roller 127, and the secondary transfer roller 129 in the image forming apparatus shown in FIG. 2. A charging voltage power circuit 43 is a charging voltage applying unit that applies a charging voltage to the charge roller 123S in the charging unit 123, and the charging unit 123 charges a surface of the photosensitive member 122 to a predetermined potential, and makes it possible to form an electrostatic latent image by laser irradiation. Here, each charging voltage power circuit 43 includes a current detecting circuit 50 that detects a current flowing between the charge roller 123S in the charging unit 123 and the photosensitive member 122, by applying the charging voltage. A development voltage power circuit 44 applies a voltage to the development roller 126S in the development unit 126 to supply toner to the electrostatic latent image on the photosensitive member 122, and forms a toner image. A primary transfer voltage power circuit 46 applies a voltage to the primary transfer roller 127 to transfer the toner image on the photosensitive member 122 to the intermediate transfer belt 27. A secondary transfer voltage power circuit 47 applies a voltage to the secondary transfer roller 129 to transfer the toner image on the intermediate transfer belt 27 to a recording material.

Figure 4:
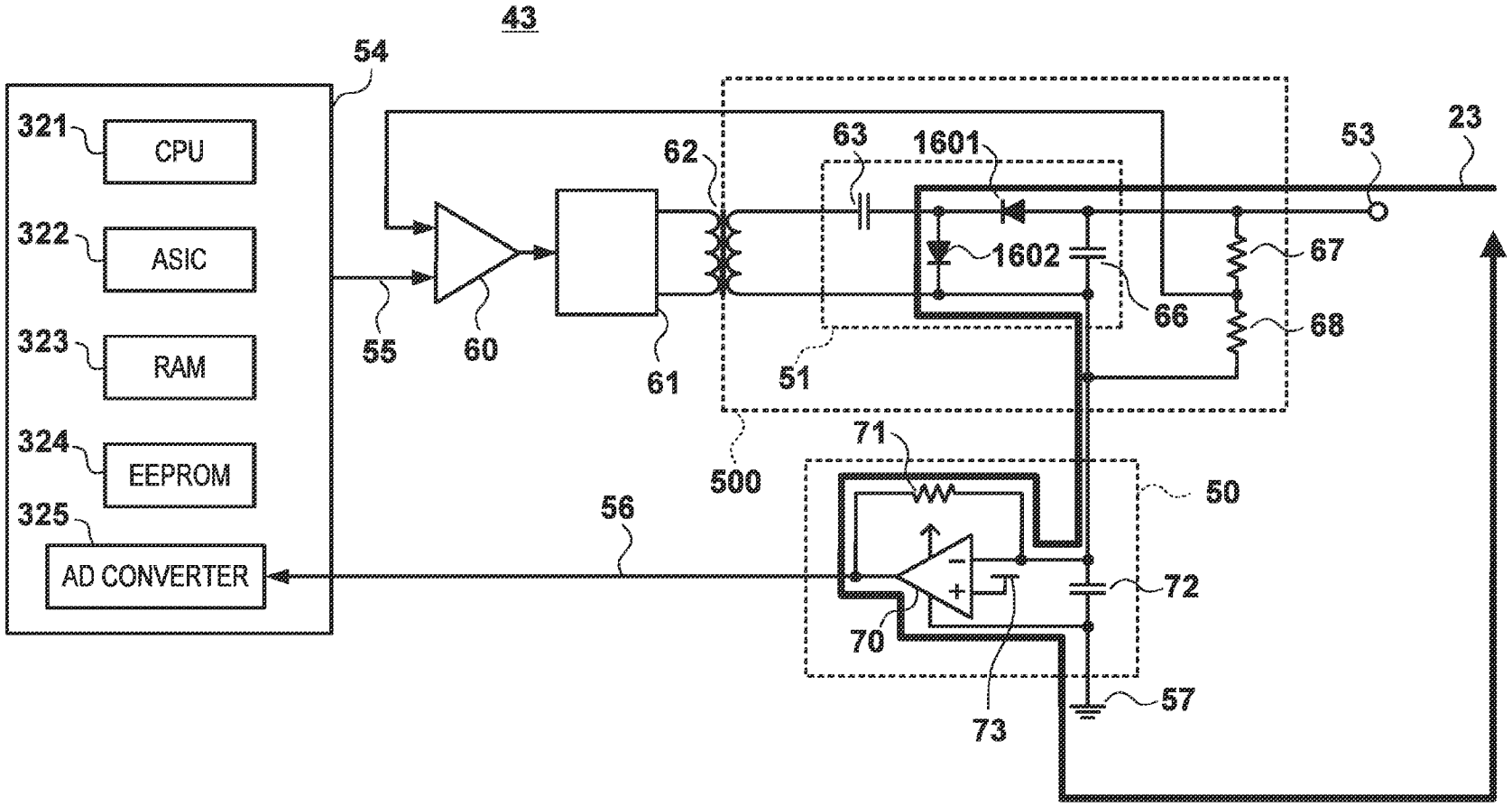
FIG. 4 is a diagram illustrating a configuration of a charging voltage power circuit according to an embodiment.

FIG. 4 is a diagram illustrating a configuration of the charging voltage power circuit 43. A transformer 62 boosts the voltage of an AC signal generated by a driving circuit 61 to tens of times the amplitude of the AC signal. A rectifier circuit 51 consisting of diodes 1601 and 1602 and capacitors 63 and 66 rectifies and smoothes the boosted AC signal and outputs the charging voltage to the charging unit 123 from an output terminal 53. A comparator 60 controls the output voltage of the driving circuit 61 so that the voltage of the output terminal 53 divided by detecting resistors 67 and 68 is made equal to a voltage setting value 55 set by an engine control unit 54. A current 23 then flows from ground to the output terminal 53 through the photosensitive member 122 and the charging unit 123, according to the voltage of the output terminal 53. Here, a current detecting circuit 50 is inserted between the secondary circuit 500 of the transformer 62 and a grounding point 57. Since an input terminal of the operational amplifier 70 has a high impedance and there is barely any flow of current, almost all the DC current flowing from the output terminal 53 to the grounding point 57 through the secondary circuit 500 of the transformer 62 flows through a resistor 71. Furthermore, the inverting terminal of the operational amplifier 70 is connected to the output terminal of the operational amplifier 70 through the resistor 71 (negative feedback), and is virtually short-circuited to a reference voltage 73 connected to the non-inverting terminal. Accordingly, on the output terminal of the operational amplifier 70 appears a detecting voltage 56 depending on the current 23 flowing through the output terminal 53. In other words, when the current 23 flowing at the output terminal 53 changes, the current flowing through the resistor 71 changes, thus changing the detecting voltage 56 of the output terminal of the operational amplifier 70, rather than the inverting terminal of the operational amplifier 70. Note that a capacitor 72 is for stabilizing the inverting terminal of the operational amplifier 70. Furthermore, the detecting voltage 56 indicating the current value of the current 23 is input to an input terminal of the engine control unit 54. An AD (analog-to-digital) converter 325 in the engine control unit 54 converts the voltage value of the detecting voltage 56 to a digital signal in order to detect the current value.

The engine control unit 54 performs overall control of the operation of the image forming apparatus described in FIG. 2. A CPU 321 uses a RAM 323 as a work area, and controls the image forming apparatus in accordance with various kinds of programs stored in an EEPROM 324. Furthermore, an ASIC 322, on the basis of instructions from the CPU 321 performs control of each motor, control of each voltage of the respective voltage supply systems shown in FIG. 3 and the like in various printing sequences. Note that some or all of the functions of the CPU 321 may be performed by the ASIC 322, or, conversely, some or all of the functions of the ASIC 322 may be performed by the CPU 321. Furthermore, some of the functions of the engine control unit 54 may be performed by other hardware. Note that although the AD converter 325 is provided in the engine control unit 54 in FIG. 4, a configuration is possible in which analog-to-digital conversion is performed outside the engine control unit 54.

Principle of Mark Generation

Figure 5A:
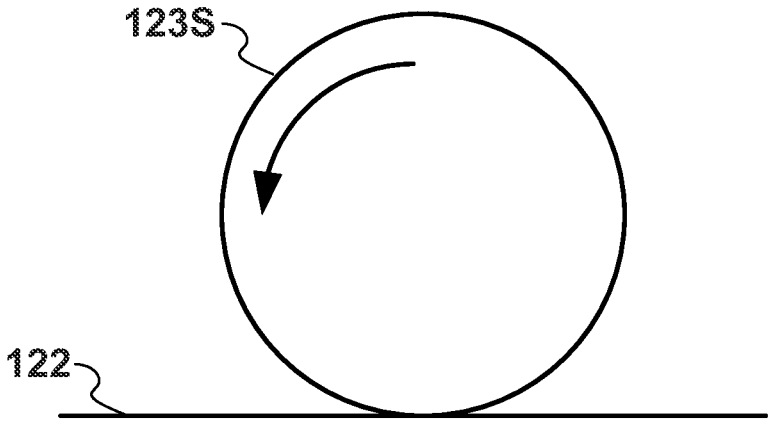
FIGS. 5A and 5B are diagrams illustrating how a pressed mark occurs.
Figure 5B:
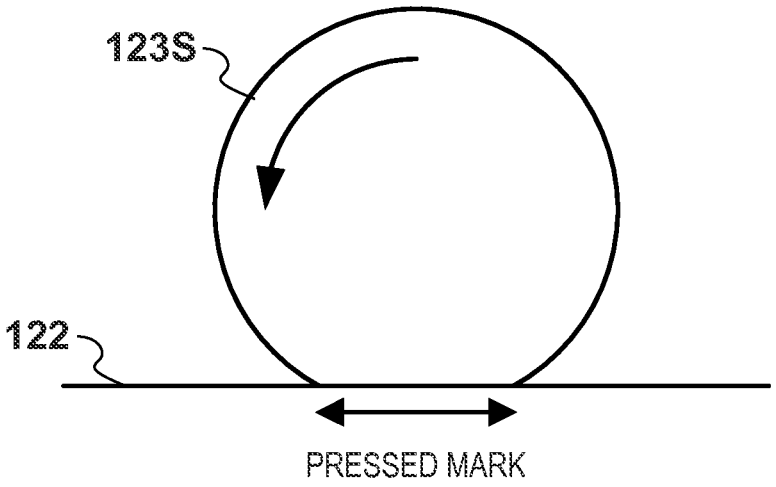

Next, a principle of mark generation will be described with reference to FIGS. 5A and 5B. The charge roller 123S is pressed against the photosensitive member 122, and rotates following the rotation of the photosensitive member 122. FIG. 5A illustrates the charge roller 123S and photosensitive member 122 in a case where they are pressed together for a sufficiently short time. In the case where the time for which they are pressed together is sufficiently short, the change in the shape of the charge roller 123S is small and the shape of the charge roller 123S is close to the ideal circle. FIG. 5B illustrates the charge roller 123S and the photosensitive member 122 in a case where they are pressed together for a long time. In the case where they are pressed together for a long time, a contact area of the charge roller 123S to the photosensitive member 122 is deformed and a mark is generated. When charging of the photosensitive member 122 is performed using the charge roller 123S having the mark, the distance of the discharge gap between the charge roller 123S and the photosensitive member 122 changes when the mark passes the discharging area by the rotation of the charge roller 123S. Accordingly, fluctuation of the charged potential according to the deformation of the mark of the charge roller 123S occurs on the surface of the photosensitive member 122. The quantity of toner supplied fluctuates in the development period due to the fluctuation of the charged potential on the surface of the photosensitive member 122, thus resulting in density unevenness.

Figure 6A:
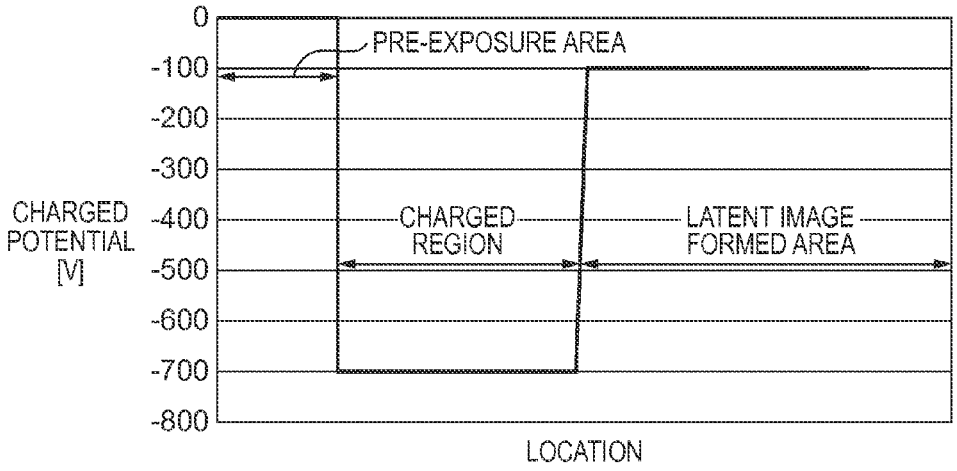
FIGS. 6A and 6B are diagrams illustrating exemplary fluctuation of charged potential of a photosensitive member.
Figure 6B:
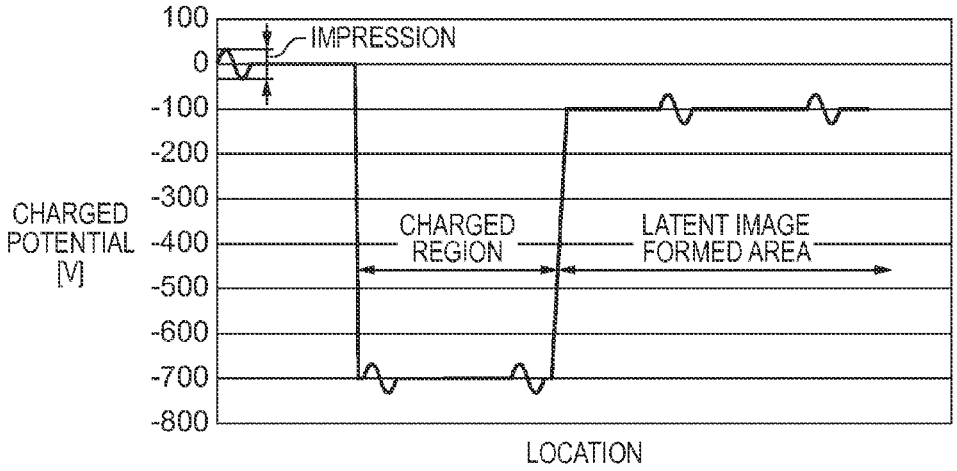

FIG. 6A is a diagram illustrating an exemplary relationship between the surface location and charged potential of the photosensitive member 122 in a case where the mark is not generated. Note that a case in which pre-exposure is performed will be described as an example here. Note that the pre-exposure is performed to remove residual charges in order to resolve a problem referred to as a memory image. As illustrated in FIG. 6A, the charges on the photosensitive member 122 in a location where the pre-exposure is performed are removed, and the surface potential of the photosensitive member 122 is 0V. Furthermore, in a location where charging is performed by the charging unit 123, the surface potential of the photosensitive member 122 is −700V. Furthermore, in a location where the electrostatic latent image is formed, the surface potential of the photosensitive member 122 is −100V. FIG. 6B is a diagram illustrating an exemplary relationship between the surface location and charged potential of the photosensitive member 122 in a case where the mark is generated. As illustrated in FIG. 6B, a voltage fluctuation of about ±30V occurs at positions in the cycle of the charge roller 123S due to the mark. In a location where the charged potential has increased, the density increases since a development contrast is high, and in a location where the charged potential has decreased, the density decreases since the development contrast is low. Note that in a case where the pre-exposure is not performed, the situation is the same.

Detection of Charged Potential Fluctuation

Figure 7:
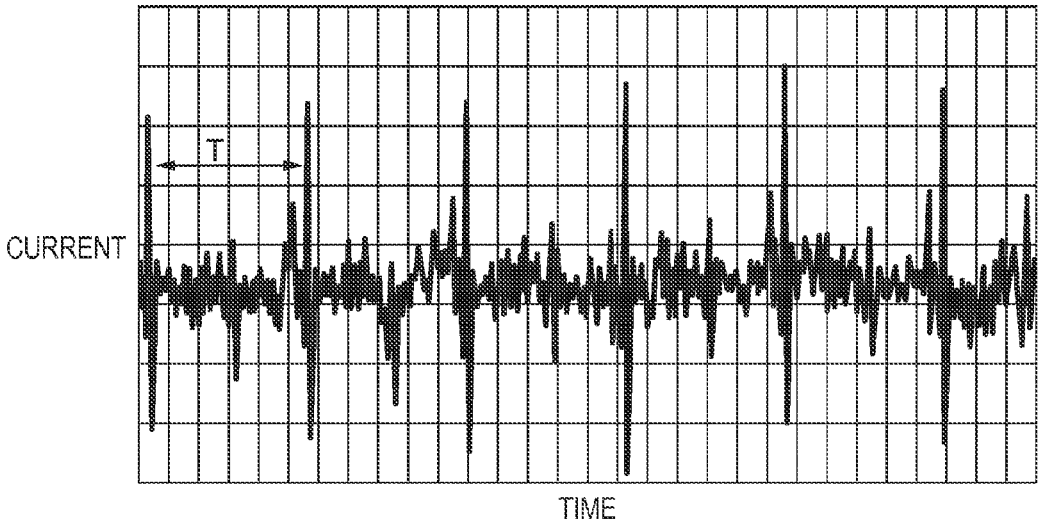
FIG. 7 is a diagram illustrating an exemplary current flowing between a photosensitive member and a charging unit when the charged potential of a photosensitive member fluctuates.

In this embodiment, the location of the fluctuation and the amount of the fluctuation of the charged potential of the photosensitive member 122 are detected by detecting the fluctuation of the current 23 by the current detecting circuit 50 shown in FIG. 4. FIG. 7 is a diagram illustrating an exemplary current 23 detected by the current detecting circuit 50. A cycle time T in FIG. 7 is the rotation period of the charge roller 123S, and it can be seen that the current detected by the current detecting circuit 50 increases and decreases a great amount at every cycle time T. This is because, as apparent from the configuration in FIG. 3, the current 23 detected by the current detecting circuit 50 increases and decreases according to the increase and decrease of the charged potential of the photosensitive member 122.

Judgment of Correction Necessity

In this embodiment, whether or not the fluctuation of the charged potential is corrected is determined by a threshold value that is pre-stored in the CPU 321 or the ASIC 322 and the fluctuation amount of the current 23. For example, if the fluctuation amount of the current 23 exceeds the threshold value, it is determined that correction is required and correction data is created, and if the fluctuation amount does not exceed the threshold value, it is determined that correction is not required. In general, density fluctuation of an image is more visibly recognizable at highlight side. Accordingly, for example, a configuration is possible in which correction data is created only in areas where density fluctuation is visibly recognizable, such as targeting density areas whose pixel value is not larger than 128 for the correction.

Correction of Charged Potential Fluctuation

Figure 1:
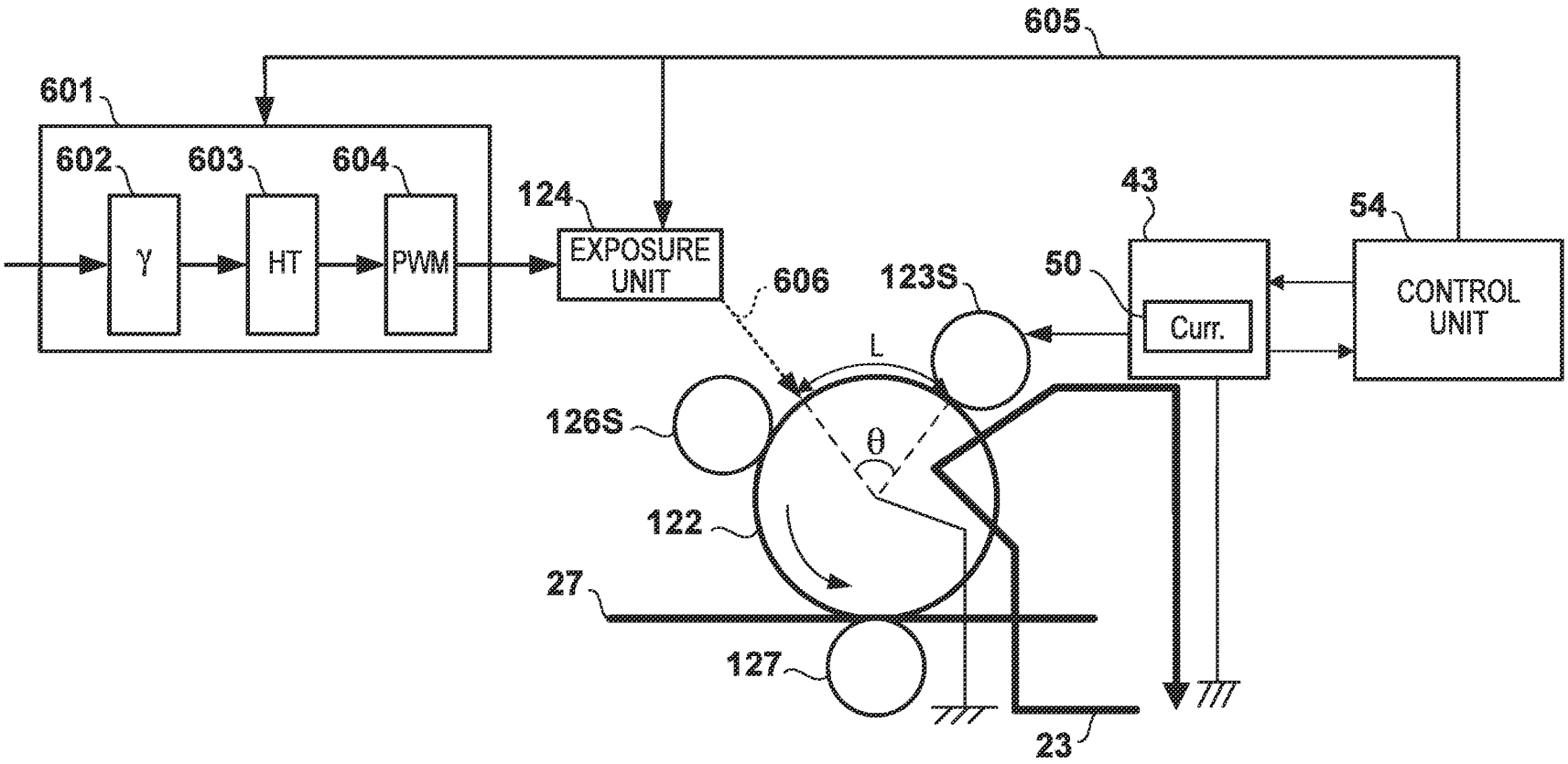
FIG. 1 is a diagram illustrating a configuration for correcting fluctuation of charged potential according to an embodiment.

FIG. 1 is a diagram illustrating a configuration for correcting the fluctuation of the charged potential according to the present embodiment. Note that constituent elements similar to the elements already described are given the same reference numerals, and descriptions thereof will not be repeated. Note that since the correction of the fluctuation of the charged potential is the same for each color, only members that form a single color on the intermediate transfer belt 27 are illustrated in FIG. 1.

In a case where potential fluctuation occurred on the photosensitive member 122 due to the mark of the charge roller 123S, the location where the potential fluctuation occurred reaches the exposure position of the exposure unit 124, when the photosensitive member 122 rotates at a predetermined angle θ (corresponds to distance L[mm]), and an electrostatic latent image is formed. Note that if the diameter of the photosensitive member 122 is d[mm], the distance L[mm] is equal to $L=d\pi\theta/360$. The engine control unit 54, as described above, determines the amount and the location of the fluctuation of the charged potential of the photosensitive member 122 from the current 23 detected by the current detecting circuit 50. After the determination, the engine control unit 54 determines the correction amount of the irradiation amount of a laser beam 606 emitted from the exposure unit 124, before the fluctuation position reaches the exposure position, and outputs correction data 605 including the determined correction amount to an image processing unit 601. The image processing unit 601 is for generating a pulse width modulation signal that drives the exposure unit 124 from the image data. In this manner, the engine control unit 54 and the image processing unit 601 constitute the correction unit that corrects the fluctuation of the charged potential of the photosensitive member 122.

Figure 8A:
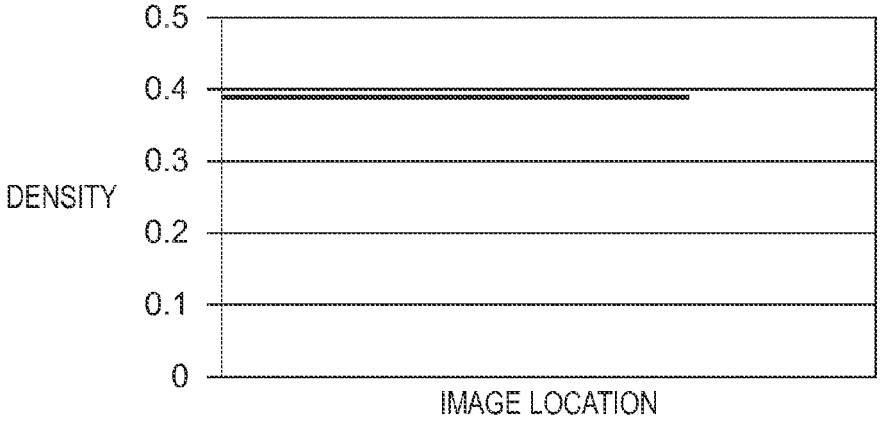
FIGS. 8A and 8B are diagrams illustrating how density fluctuation occurs due to the fluctuation of the charged potential.
Figure 8B:
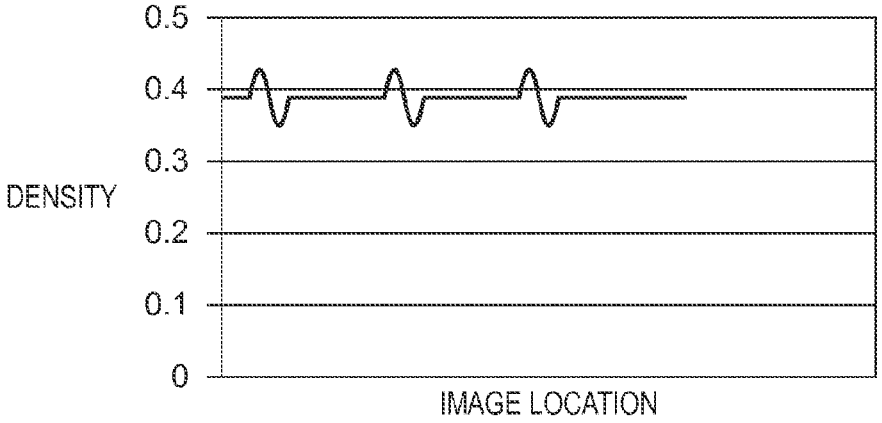
Figure 9A:
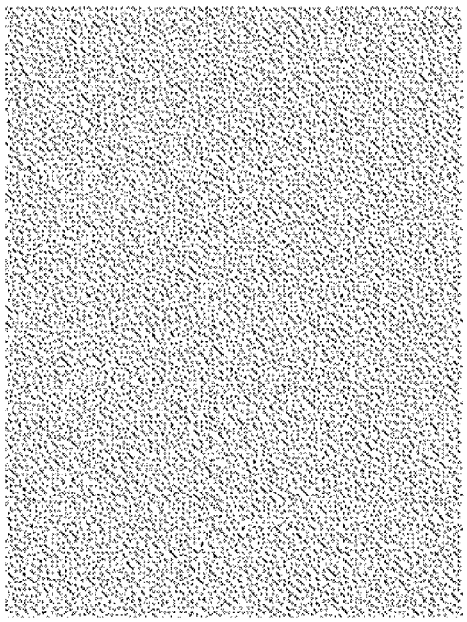
FIGS. 9A and 9B are diagrams illustrating an exemplary image caused by the fluctuation of the charged potential.
Figure 9B:
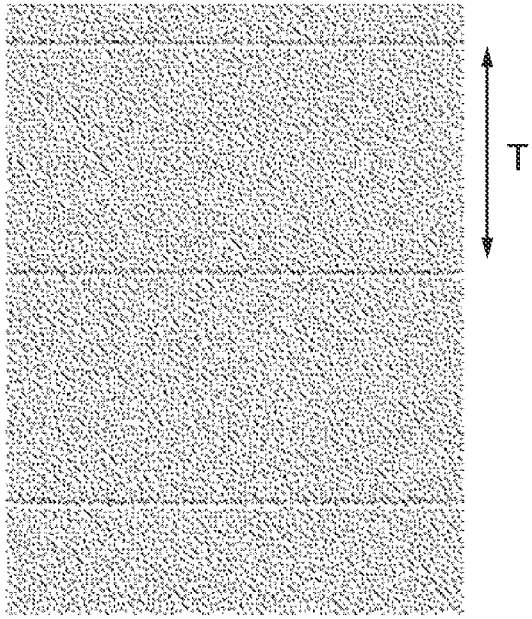

FIGS. 8A and 8B are diagrams illustrating density fluctuation caused by the fluctuation of the charged potential. Note that the density here is a quantified number based on the light reflectivity of the recording material, and a value compliant with the ISO status A is used. FIG. 8A illustrates density distribution in a case where the fluctuation of the charged potential does not occur. FIG. 8B illustrates density distribution in a case where the fluctuation of the charged potential does occur. FIGS. 9A and 9B are diagrams illustrating an exemplary output image made visible by the toner. Usually, an image signal is expressed by 8-bit data, and it is assumed here that the pixel value 0 expresses white and the pixel value 255 expresses black. Furthermore, in an electrophotographic image forming apparatus, in general, the pixel value 0 corresponds to a density of about 0.1, and the pixel value 255 corresponds to a density of about 1.5. FIG. 9A illustrates an exemplary output image of image data in which the pixel value is "51", in a case where there is no fluctuation in the charged potential. FIG. 9B illustrates an exemplary output image of image data in which the pixel value is "51", in a case where there is fluctuation in the charged potential. As illustrated in FIG. 9B, when there is fluctuation in the charged potential, the density unevenness occurs at the rotation cycle of the charge roller 123S. In this embodiment, the fluctuation amount of the charged potential is calculated from the fluctuation of the current 23 detected at the time of charging, and correction data 605 for the irradiation amount which counters the fluctuation of the charged potential is created. The correction data 605 is fed back to the image processing unit 601, and the amount of light irradiated by the laser beam 606 is controlled taking the correction data into consideration, and thus the influence of the fluctuation of the charged potential is relaxed at the time of exposure, and an image without density unevenness can be obtained.

Note that, as a method of feedback, two types of feedback can be considered, one of which is to perform feedback to the intensity of the laser beam and the other is to perform feedback to the image data. Each method will now be described.

Method of Feedback to Light Intensity

Figure 10A:
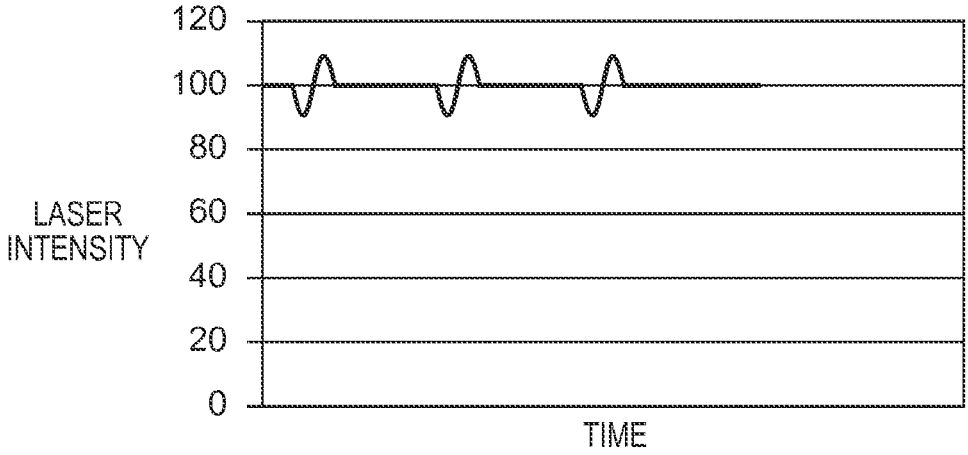
FIGS. 10A and 10B are diagrams illustrating correction of the fluctuation of the charged potential of a photosensitive member according to an embodiment.

In this method, the laser emission intensity from the exposure unit 124, that is, an amount of current caused to flow through a laser diode is corrected based on the fluctuation of the charged potential. FIG. 10A is a diagram illustrating correction data 605 for laser beam intensity that is for correcting the density unevenness shown in FIG. 8B. Note that, in FIG. 10A, the normal intensity of a laser beam is assumed to be 100%. As illustrated in FIG. 10A, in a location where the density is desirably lower, the intensity of the laser beam is reduced, and in a location where the density is desirably higher, the intensity of the laser beam is increased. In this manner, the strength of the laser emission intensity is adjusted based on the fluctuation of the detected charging current. Accordingly, a favorable image without density unevenness can be obtained by correcting the fluctuation of the charged potential at the time of exposure.

Method of Feedback to Image

Figure 10B:
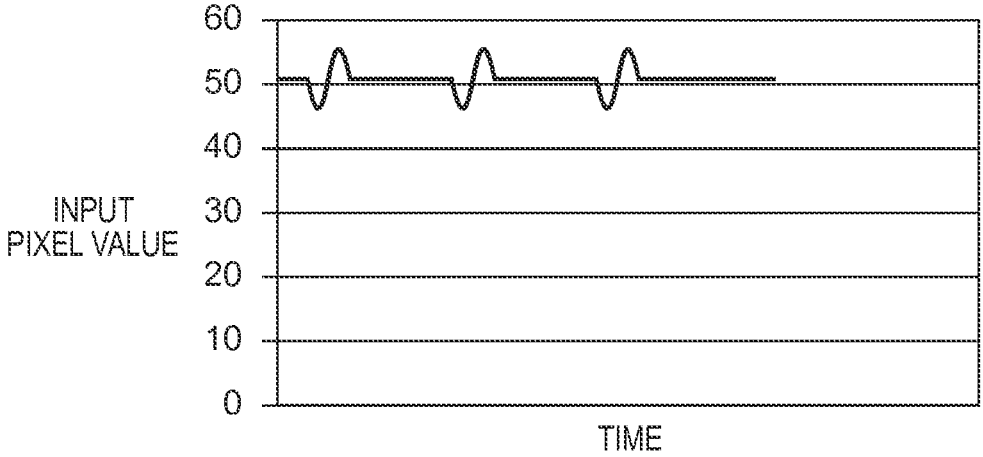

As illustrated in FIG. 1, the image processing unit 601 is provided with a gamma correction unit 602, a half tone processing unit 603, and a PWM processing unit 604. The gamma correction unit 602 corrects error so that the tone characteristics of the output image are faithful to the original data. The half tone processing unit 603 has a predetermined threshold table, and compares the threshold table with the original data to realize a pseudo halftone expression. The PWM processing unit 604 divides each pixel of the image data on which the gamma correction and the half tone processing have been performed into a plurality of parts, and adjusts the emission period of the laser beam. In this method, for example, among the image data input to the gamma correction unit 602, the pixel values of the pixels corresponding to the mark are directly corrected based on the fluctuation of the charged potential. However, a configuration is possible in which the feedback is performed in the gamma correction or the PWM processing. FIG. 10B is a diagram illustrating correction data 605 for image data that is for correcting the density unevenness shown in FIG. 8B. Similar to FIG. 10A, in a location where the density is desired to be lower, the pixel number is to be reduced, and in a location where the density is desired to be higher, the pixel number is to be increased. In this manner, the level of the image density is adjusted based on the fluctuation of the detected charging current. Accordingly, a good image without density unevenness can be obtained by correcting the fluctuation of the charged potential at the time of exposure.

Operation Sequence

Figure 11:
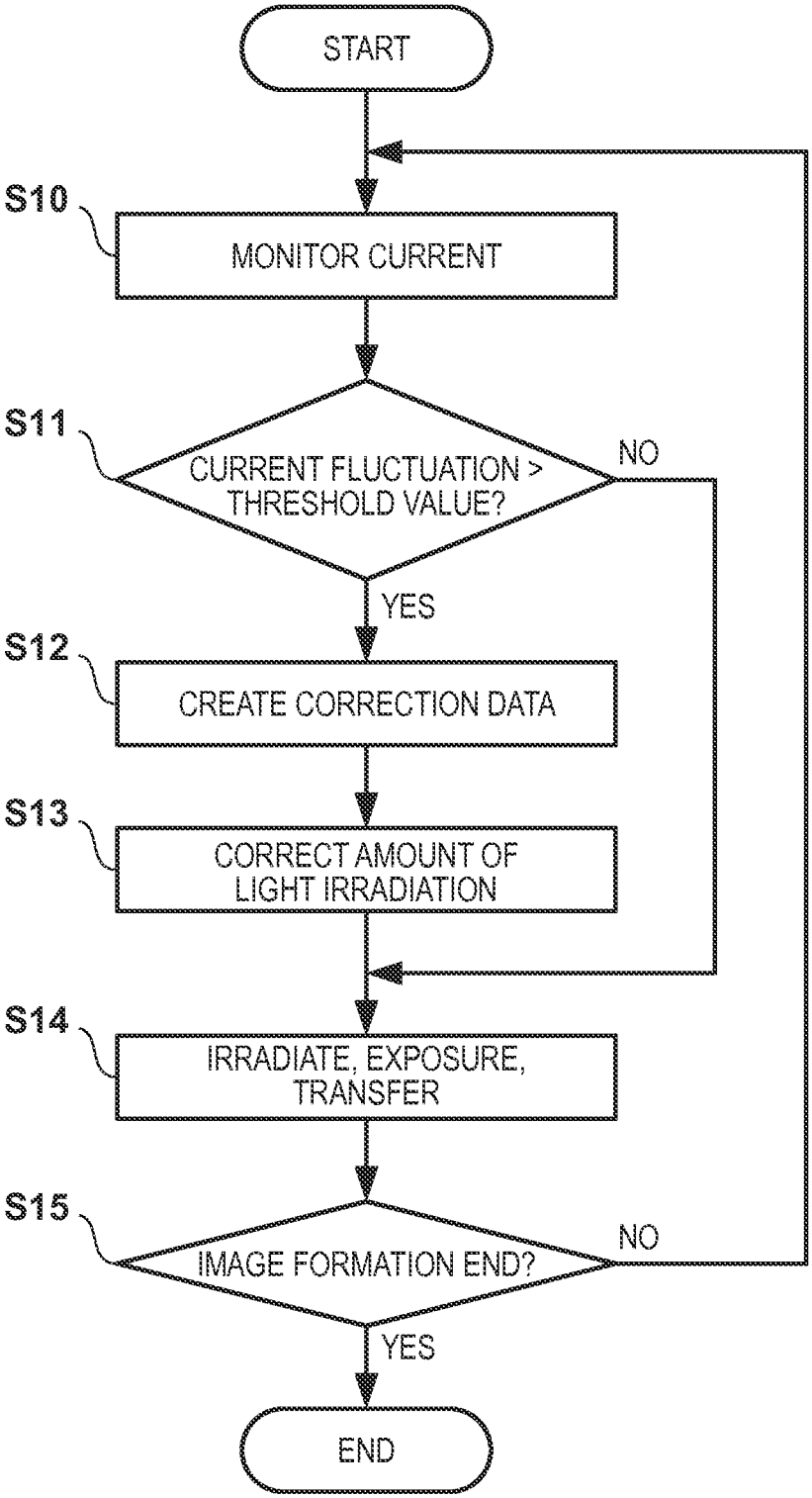
FIG. 11 is a flowchart of a correction operation for density unevenness caused by the fluctuation of the charged potential of a photosensitive member according to an embodiment.
Figure 12:
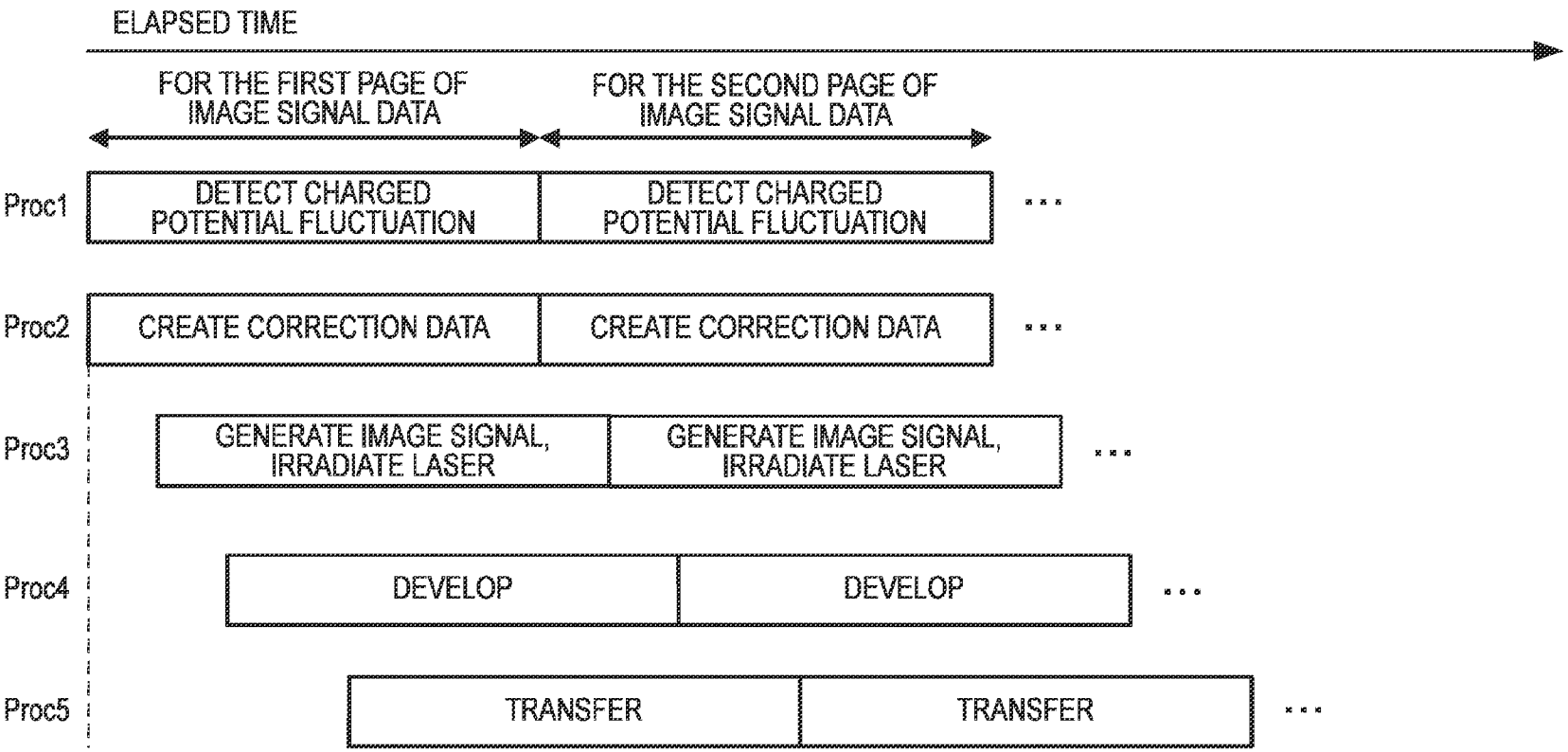
FIG. 12 is a timing chart of an image forming operation according to an embodiment.

FIG. 11 is a flow chart of the correction operation performed by the CPU 321 or the ASIC 322 in the engine control unit 54 for the density unevenness caused by the fluctuation of the charged potential. Furthermore, FIG. 12 is a timing chart of an image forming operation of the image forming apparatus according to the present embodiment. The engine control unit 54, upon receiving an instruction to form an image from a host computer or the like not shown in the diagrams, starts monitoring the current 23 in S10, in order to detect fluctuation of the charged potential. Subsequently, in S11, the engine control unit 54 determines whether or not the fluctuation of the charged potential is a level that will cause density unevenness, by comparing the current 23 with the threshold value. The operations described above are performed in Proc 1 in FIG. 12. In S11, if the fluctuation of the current 23 is larger than the threshold value, the engine control unit 54 creates correction data 605 in S12. Meanwhile, if the fluctuation of the current 23 is not larger than the threshold value, the process proceeds to S14 without creating correction data 605. The operation in S12 is performed in Proc 2 in FIG. 12. The engine control unit 54, in S13, adjusts the timing to correct the amount of light irradiation so that the image is corrected when the location of the fluctuation of the charged potential arrives at the exposure position. Subsequently, in S14, the electrostatic latent image is formed, and development and transfer are performed. The operations in S13 and S14 are performed from Proc 3 to Proc 5 in FIG. 12. Note that if the fluctuation of the current 23 is not larger than the threshold value in S11, the electrostatic latent image is formed, in S14, and development and transfer are performed. The engine control unit 54, in S15, determines whether or not all image formation is completed, and, in a case all image formation is completed, terminates the printing operation, and otherwise, repeats the operations from S10.

As described above, the fluctuation of the charged potential on the photosensitive member 122 is detected by the fluctuation of the current 23 flowing between the charging unit 123 and the photosensitive member 122. By creating the correction data for the amount of light irradiation from the detected fluctuation amount and correcting the amount of light irradiation, the density unevenness caused by the fluctuation of the charged potential which, for example, results from the pressed mark can be suppressed in real-time.

Note that an embodiment can be configured in which the density of pixels to be formed at the location on the photosensitive member 122 where the charged potential is larger than a predetermined first value is reduced, and the density of pixels to be formed at the location on the photosensitive member 122 where the charged potential is smaller than a predetermined second value is increased. Note that the second value is not larger than the first value. Similarly, an embodiment can be configured in which an emission intensity of the laser irradiated on the photosensitive member 122 where the charged potential is larger than a predetermined first value is reduced, and the emission intensity of the laser irradiated on the photosensitive member 122 where the charged potential is smaller than a predetermined second value is increased.

Second Embodiment

Figure 13:
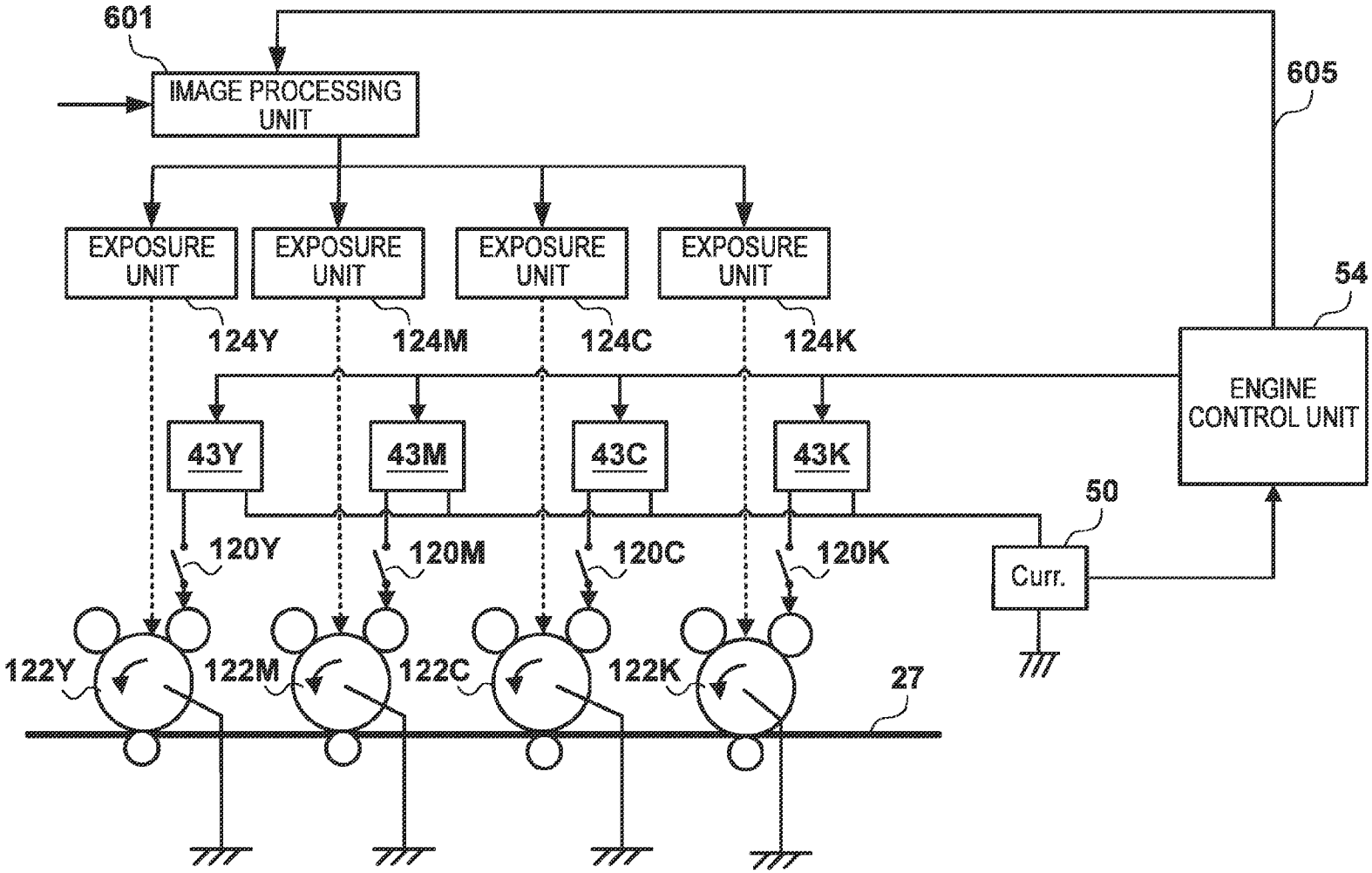
FIG. 13 is a diagram illustrating a configuration for correcting the fluctuation of the charged potential according to an embodiment.

Next, a second embodiment will be described focusing on the difference from the first embodiment. In the first embodiment, a current detecting circuit 50 is provided for the respective colors. In this embodiment, a current detecting circuit 50 is commonly used for all of a plurality of colors, which are four colors in this example. FIG. 13 is a diagram illustrating a configuration for correcting fluctuation of the charged potential according to the present embodiment. As illustrated in FIG. 13, in this embodiment, the current detecting circuit 50 is commonly used among the charging voltage power circuits 43Y to 43K, and switches 120Y to 120K are provided to turn on and off the outputs of the charging voltage power circuits 43Y to 43K. Since one current detecting circuit 50 is commonly used for four colors, in this embodiment, it may not be able to detect which of the photosensitive members 122 and the charge rollers 123S the current 23 flowed through. In order to solve this problem, at the start of the printing operation, firstly, the charging voltage is sequentially applied to each of the charging units 123 for the respective colors.

Figure 14:
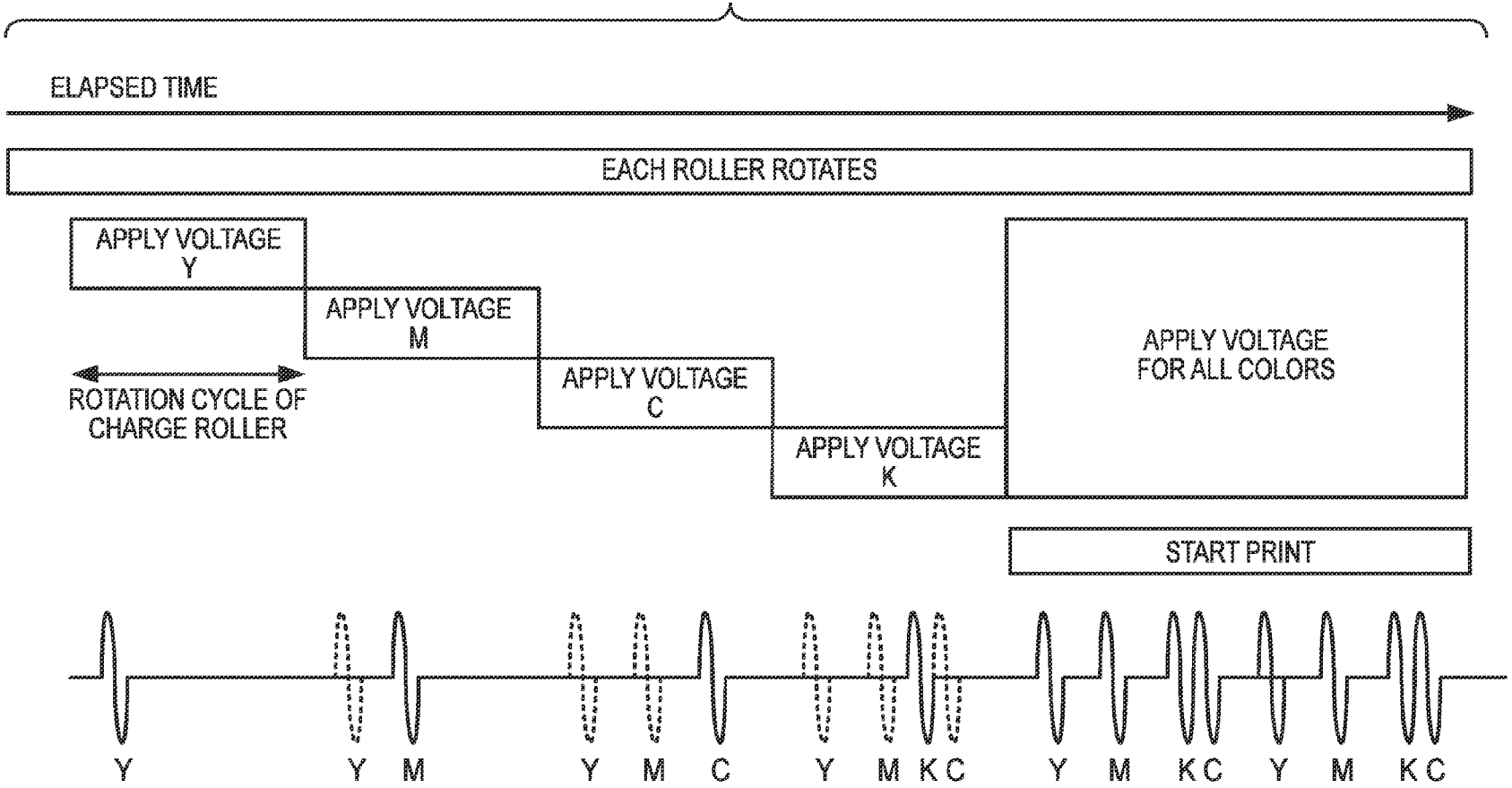
FIG. 14 is a sequence diagram of a correction processing for density unevenness caused by the fluctuation of the charged potential of a photosensitive member according to an embodiment.

FIG. 14 is a sequence diagram of an operation sequence according to the present embodiment. To begin with, each of the charging rollers 123S for the respective colors is rotated. Next, the switch 120Y is turned on, and the charging voltage is applied to the charge roller 123S corresponding to yellow. Subsequently, if the fluctuation of the current 23 caused by the mark is detected, the detection time is recorded. After the charge roller 123S corresponding to yellow has rotated full circle, the switch 120Y is turned off to stop applying the charging voltage to the charge roller 123S corresponding to yellow. Note that the waveform in FIG. 14 represents the time at which the fluctuation of the current 23 is detected. Subsequently, in a similar manner, the switches 120M, 120C, and 120K corresponding to the detection target colors are turned on sequentially, and the current 23 is detected by applying the charging voltage from the charging voltage power circuit 43 of the corresponding color. Subsequently, all the switches 120Y, 120M, 120C, and 120K are turned on, and image forming is performed by applying the charging voltage to all the charge rollers 123S. In the image forming, the amount of light irradiation is corrected based on the time at which the fluctuation of the current 23 was detected for each color, in a similar manner to the first embodiment.

According to the configuration described above, the number of current detecting circuits 50 can be suppressed, and thus density unevenness caused by the fluctuation of the charged potential can be suppressed with a low cost configuration. Note that, in the embodiment described above, although one current detecting circuit 50 is provided for four colors, a configuration is possible in which one current detecting circuit 50 is provided to detect the current 23 flowing through at least two charge rollers 123S.

Third Embodiment

Figure 15:
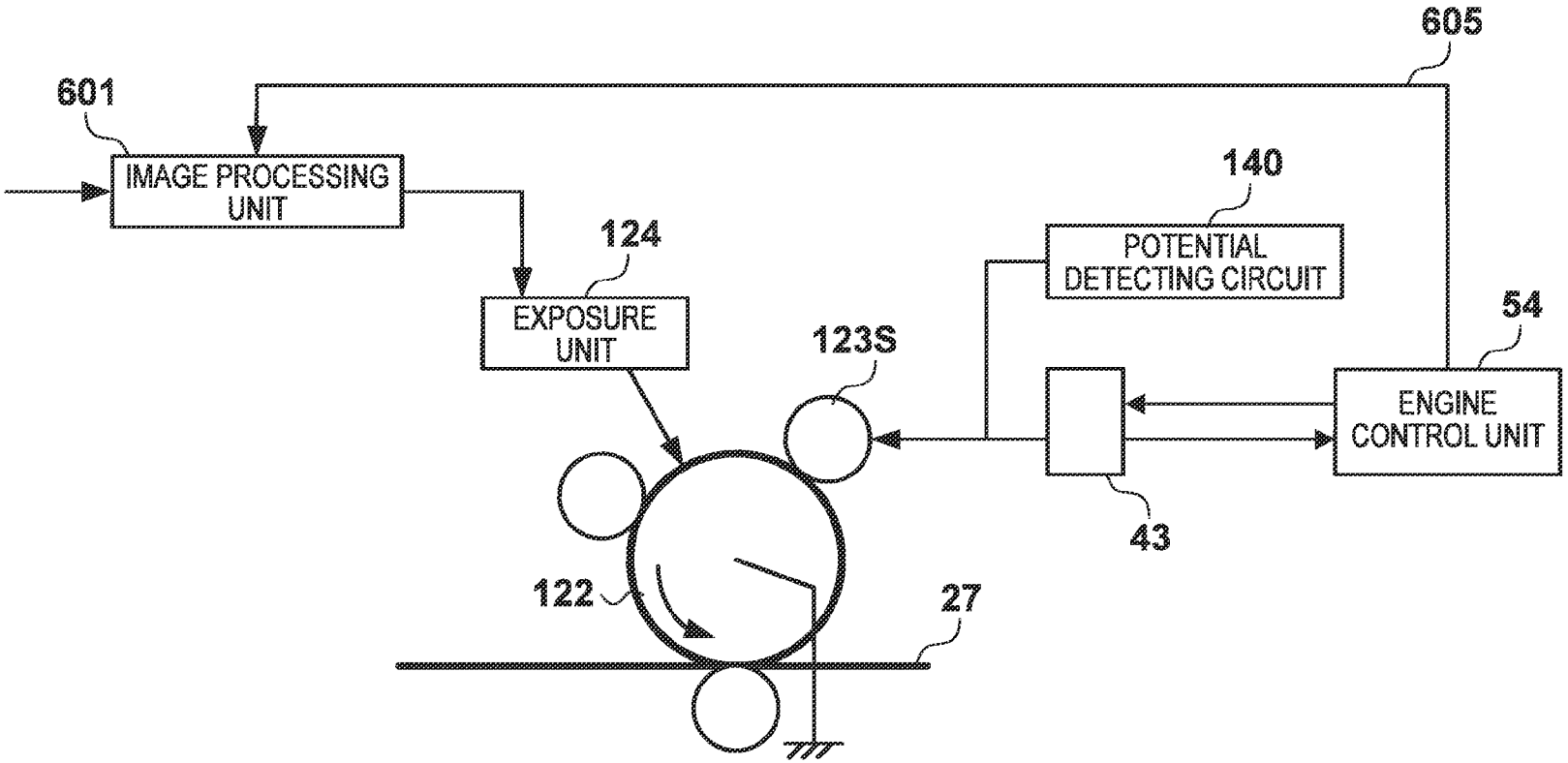
FIG. 15 is a diagram illustrating a configuration for correcting the fluctuation of the charged potential according to an embodiment.

Next, a third embodiment will be described focusing on the difference from the first embodiment. In the present embodiment, as illustrated in FIG. 15, instead of the current detecting circuit 50, a potential detecting circuit 140 is used. The potential detecting circuit 140 detects potential at the connecting line between the charging voltage power circuit 43 and the charge roller 123S, and calculates the surface potential of the photosensitive member 122.

Figure 16:
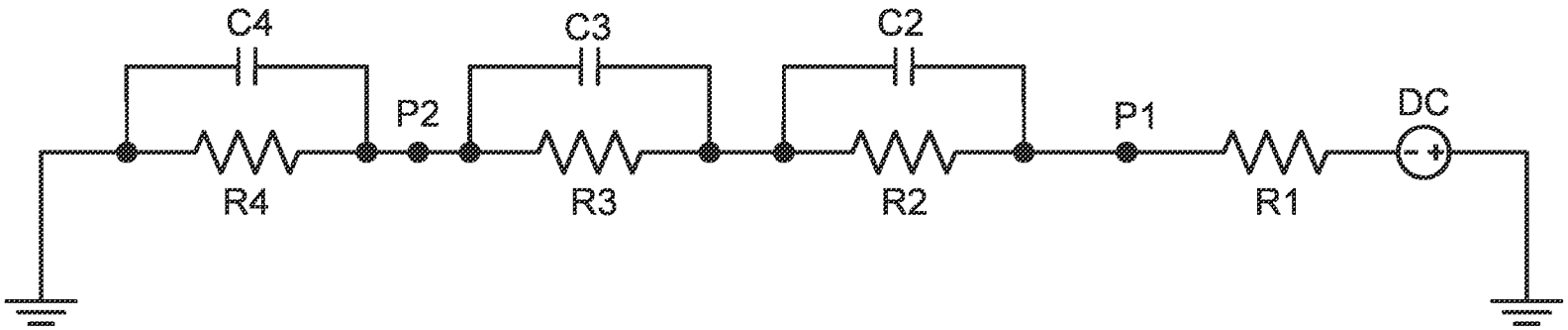
FIG. 16 is an equivalent circuit of a voltage detecting system according to an embodiment.

FIG. 16 illustrates an equivalent circuit between the charging voltage power circuit 43, the charge roller 123S, and the photosensitive member 122, and ground. R1 in FIG. 16 corresponds to the internal resistance of the charging voltage power circuit 43, and the value thereof is sufficiently small. R2 and C2 correspond to the resistance component and the capacitance component of the charge roller 123S. R3 and C3 correspond to the resistance component and the capacitance component formed between the charge roller 123S and the photosensitive member 122, that is, formed at the mark. R4 and C4 correspond to the resistance component and the capacitance component of the photosensitive member 122. P1 is the potential at the node between the internal resistance R1 of the charging voltage power circuit 43 and the resistance component R2 and the capacitance component C2 of the charge roller 123S. P2 is the potential at the node between the mark and the photosensitive member 122, that is, the surface potential of the photosensitive member 122. Here, R1, R2, R4, C2, and C4 are assumed to be fixed values and do not fluctuate, and R3 and C3 fluctuate under the influence of the pressed mark. Accordingly, by detecting the potential at P1, the potential at P2 can be estimated, and the density unevenness caused by the fluctuation of the charged potential can be corrected by creating correction data 605 using the detected potential P1. Note that, in this embodiment, similar to the first embodiment, a configuration is possible in which the potential detecting circuit 140 detects the potential of the charge rollers 123S of at least two colors.

Other Embodiments

Note that in the embodiments described above, although all of the colors of a four-color image forming apparatus are corrected, a configuration is possible in which only specific colors are corrected. Note that this configuration can be applied to a single-color image forming apparatus. Furthermore, in the embodiments described above, although an exposure unit 124 is provided for the respective colors, an exposure unit 124 may be commonly provided for the respective colors. Note that an image processing unit 601 may be provided individually for the respective colors, or may be provided commonly.

Aspects of the present invention can also be realized by a computer of a system or apparatus (or devices such as a CPU or MPU) that reads out and executes a program recorded on a memory device to perform the functions of the above-described embodiments, and by a method, the steps of which are performed by a computer of a system or apparatus by, for example, reading out and executing a program recorded on a memory device to perform the functions of the above-described embodiments. For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-146083, filed on Jun. 28, 2012 which is hereby incorporated by reference herein in its entirety.

What is claimed is:

1. An image forming apparatus comprising:

a rotatable photosensitive member;

a charging unit configured to charge the photosensitive member;

an exposure unit configured to form an electrostatic latent image on the photosensitive member by exposing the charged photosensitive member;

a detecting unit configured to detect a current flowing between the charging unit and the photosensitive member; and a correction unit configured to determine a fluctuation location of the charged potential of the photosensitive member according to a fluctuation amount of the current detected by the detecting unit, the fluctuation location being caused by contact between a portion of the charging unit and the photosensitive member, and to correct an amount of light irradiated by the exposure unit onto the photosensitive member at the fluctuation location of the charged potential.

2. The image forming apparatus according to claim 1, wherein the photosensitive member, the charging unit, and the detecting unit are provided corresponding to each color used in image forming.

3. The image forming apparatus according to claim 1, wherein the photosensitive member and the charging unit are provided corresponding to each color used in image forming, and the detecting unit is further configured to detect the current flowing between the charging unit and the photosensitive member corresponding to each of a plurality of colors.

4. The image forming apparatus according to claim 3, further comprising:

a charging voltage applying unit configured to apply voltage to each charging unit, and when the detecting unit, which detects the current flowing between the charging unit and the photosensitive member corresponding to each of the plurality of colors, detects the current flowing between the charging unit and the photosensitive member corresponding to one color, the charging voltage applying unit is further configured to stop applying the voltage to the charging unit corresponding to the other colors of the plurality of colors.

5. The image forming apparatus according to claim 1, wherein the correction unit is further configured to correct the amount of irradiation by the exposure unit, when the fluctuation amount is larger than a threshold value.

6. The image forming apparatus according to claim 1, wherein the correction unit is further configured to correct the amount of irradiation by the exposure unit, by correcting a pixel value of image data according to the fluctuation amount.

7. The image forming apparatus according to claim 1, wherein the correction unit is further configured to correct the amount of irradiation by the exposure unit, by correcting the intensity of light irradiated by the exposure unit according to the fluctuation amount.

8. The image forming apparatus according to claim 6, wherein the correction unit is further configured to correct the density of a pixel of image data so that the density of the pixel decreases at the fluctuation location where the charged potential is larger than a predetermined value, and the density of the pixel increases at the fluctuation location where the charged potential is smaller than the predetermined value.

9. The image forming apparatus according to claim 7, wherein the correction unit is further configured to correct the amount of irradiation by the exposure unit so that the intensity of the light of the exposure unit irradiated at the fluctuation location where the charged potential is larger than the predetermined value decreases, and the intensity of the light of the exposure unit irradiated at the fluctuation location where the charged potential is smaller than the predetermined value increases.

10. The image forming apparatus according to claim 1, wherein the correction unit is further configured to, after the determination of the fluctuation location of the charged potential of the photosensitive member, determine the correction amount of light irradiated at the fluctuation location by the exposure unit, before the fluctuation location comes to the exposure position.

11. An image forming apparatus comprising:

a rotatable photosensitive member;

a charging unit configured to charge the photosensitive member;

a charging voltage applying unit configured to apply a voltage to the charging unit;

an exposure unit configured to form an electrostatic latent image on the photosensitive member by exposing the charged photosensitive member;

a detecting unit configured to detect a potential between the charging unit and the photosensitive member; and a correction unit configured to determine a fluctuation location of the charged potential of the photosensitive member according to a fluctuation amount of the potential detected by the detecting unit, the fluctuation location being caused by contact between a portion of the charging unit and the photosensitive member, and to correct an amount of light irradiated by the exposure unit onto the photosensitive member at the fluctuation location of the charged potential.

12. The image forming apparatus according to claim 11, wherein the correction unit is further configured to correct the amount of irradiation by the exposure unit, when the fluctuation amount is larger than a threshold value.

13. The image forming apparatus according to claim 11, wherein the correction unit is further configured to correct the amount of irradiation by the exposure unit, by correcting a pixel value of image data according to the fluctuation amount.

14. The image forming apparatus according to claim 11, wherein the correction unit is further configured to correct the amount of irradiation by the exposure unit, by correcting the intensity of light irradiated by the exposure unit according to the fluctuation amount.

15. The image forming apparatus according to claim 13, wherein the correction unit is further configured to correct the density of a pixel of image data so that the density of the pixel decreases at the fluctuation location where the charged potential is larger than a predetermined value, and the density of the pixel increases at the fluctuation location where the charged potential is smaller than the predetermined value.

16. The image forming apparatus according to claim 14, wherein the correction unit is further configured to correct the amount of irradiation by the exposure unit so that the intensity of the light of the exposure unit irradiated at the fluctuation location where the charged potential is larger than the predetermined value decreases, and the intensity of the light of the exposure unit irradiated at the fluctuation location where the charged potential is smaller than the predetermined value increases.

17. The image forming apparatus according to claim 11, wherein the correction unit is further configured to, after the determination of the fluctuation location of the charged potential of the photosensitive member, determine the correction amount of light irradiated at the fluctuation location by the exposure unit, before the fluctuation location comes to the exposure position.

18. The image forming apparatus according to claim 1, wherein the correction unit is further configured to determine a fluctuation amount of the charged potential of the photosensitive member according to the fluctuation amount of the current detected by the detecting unit, and to correct the amount of light irradiated by the exposure unit according to the determined fluctuation amount of the charged potential.

19. The image forming apparatus according to claim 11, wherein the correction unit is further configured to determine a fluctuation amount of the charged potential of the photosensitive member according to the fluctuation amount of the potential detected by the detecting unit, and to correct the amount of light irradiated by the exposure unit according to the determined fluctuation of the charged potential.

20. The image forming apparatus according to claim 1, wherein the detecting unit is further configured to detect the current flowing while the charging unit rotates one revolution.

21. The image forming apparatus according to claim 11, wherein the detecting unit is further configured to detect the potential while the charging unit rotates one revolution.

22. The image forming apparatus according to claim 1, wherein the portion of the charging unit is a portion where the charging unit is deformed by the contact with the photosensitive member and a pressed mark is generated.

23. The image forming apparatus according to claim 11, wherein the portion of the charging unit is a portion where the charging unit is deformed by the contact with the photosensitive member and a pressed mark is generated.

24. The image forming apparatus according to claim 1, wherein the portion of the charging unit is a portion where the charging unit is contact with the photosensitive member while the photosensitive member and the charging unit are not used for a given period.

25. The image forming apparatus according to claim 11, wherein the portion of the charging unit is a portion where the charging unit is contact with the photosensitive member while the photosensitive member and the charging unit are not used for a given period.

* * * * *